US008823615B2

(12) United States Patent
Lee et al.

(10) Patent No.: US 8,823,615 B2
(45) Date of Patent: Sep. 2, 2014

(54) DRIVING METHOD AND DRIVING APPARATUS OF LIQUID CRYSTAL DISPLAY

(75) Inventors: Ki-Chan Lee, Cheonan-si (KR); Dong-Won Park, Cheonan-si (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 1578 days.

(21) Appl. No.: 11/931,297

(22) Filed: Oct. 31, 2007

(65) Prior Publication Data

US 2008/0198151 A1 Aug. 21, 2008

(30) Foreign Application Priority Data

Feb. 15, 2007 (KR) ..... 10-2007-0015846

(51) Int. Cl.
*G09G 3/36* (2006.01)

(52) U.S. Cl.
CPC ..... *G09G 3/36* (2013.01); *G09G 3/3648* (2013.01); *G09G 2360/16* (2013.01); *G09G 2320/0271* (2013.01); *G09G 2320/0673* (2013.01); *G09G 2360/144* (2013.01); *G09G 2320/066* (2013.01)
USPC ..... 345/87; 345/88; 345/89; 345/204; 345/207; 345/690; 382/165; 382/167; 358/1.9

(58) Field of Classification Search
USPC ..... 345/204, 207, 690, 87, 88, 89; 382/165, 382/168; 358/1.9
See application file for complete search history.

(56) References Cited

U.S. PATENT DOCUMENTS

| | | | | |
|---|---|---|---|---|
| 6,697,127 | B2 * | 2/2004 | Suzuki | 348/674 |
| 6,788,370 | B2 * | 9/2004 | Itou et al. | 349/117 |
| 6,888,528 | B2 * | 5/2005 | Rai et al. | 345/102 |
| 7,265,795 | B2 * | 9/2007 | Ohyama et al. | 348/675 |
| 2005/0123193 | A1 | 6/2005 | Lanberg et al. | |
| 2006/0033749 | A1 | 2/2006 | Yamada | |
| 2006/0055828 | A1 * | 3/2006 | Henry et al. | 348/674 |
| 2006/0247877 | A1 * | 11/2006 | Bala et al. | 702/107 |

FOREIGN PATENT DOCUMENTS

| | | |
|---|---|---|
| EP | 1624678 A1 | 2/2006 |
| JP | 11-234539 | 8/1999 |
| JP | 2001-134235 | 5/2001 |
| JP | 2004-294767 | 10/2004 |
| JP | 2004-320632 | 11/2004 |
| JP | 2005-181731 | 7/2005 |
| JP | 2005-295513 | 10/2005 |
| JP | 2006-285064 | 10/2006 |
| KR | 1020020054874 | 7/2002 |
| KR | 1020030035397 | 5/2003 |
| KR | 1020040002291 | 1/2004 |
| KR | 1020060008644 | 1/2006 |
| KR | 100555303 | 2/2006 |
| KR | 1020060081218 | 7/2006 |

OTHER PUBLICATIONS

European Search Report dated May 6, 2010 for Application No. 08002006.8-1228/1959419.

* cited by examiner

*Primary Examiner* — Grant Sitta
(74) *Attorney, Agent, or Firm* — F. Chau & Associates, LLC

(57) ABSTRACT

A driving method includes sensing illuminance of ambient light determining a first contrast ratio based on the sensed illuminance, determining a second contrast ratio and a relative ratio of the contrast ratio, determining a gradient of a compensation gamma curve using the relative ratio, determining an average gray of input data signals, and determining the compensation gamma curve.

18 Claims, 6 Drawing Sheets

DRIVING METHOD AND DRIVING APPARATUS OF LIQUID CRYSTAL DISPLAY

CROSS-REFERENCE TO RELATED PATENT APPLICATION

This application claims priority to Korean Patent Application No. 10-2007-0015846, filed on Feb. 15, 2007, the contents of which are herein incorporated by reference in their entirety.

BACKGROUND OF THE INVENTION

1. Technical Field

The present invention relates to a driving method and a driving apparatus of a liquid crystal display.

2. Discussion of Related Art

A liquid crystal display (LCOD) includes two panels provided with field generating electrodes, such as pixel electrodes and a common electrode, and a liquid crystal layer that has a dielectric anisotropy interposed therebetween. LCDs further include switching devices such as thin film transistors (TFTs) connected to the pixel electrodes and a plurality of signal lines such as gate lines and data lines to control the switching devices to apply voltages to the pixel electrodes. A common voltage is applied to the common electrode, which may be formed over the entire surface of one of two panels. The pixel electrodes, the common electrode, and the liquid crystal layer interposed therebetween together form liquid crystal capacitors.

A liquid crystal capacitor together with a switching element connected thereto forms a unit cell or "pixel". An LCD includes a plurality of pixels arranged in a matrix.

An LCD generates an electric field in the liquid crystal layer by applying voltages to the field generating electrodes. The strength of the electric field is controlled to control transmittance of light that passes through the liquid crystal layer, thus obtaining desired images. To prevent degradation of the liquid crystal that can result when the electric field is applied for a long time in one direction to the liquid crystal layer, polarity of the data voltages with respect to the common voltage may be inverted by frames, by rows, or by pixels.

LCDs have been used as display devices for advertisement in outdoor environments.

Light that is reflected by an LCD screen increases as the illuminance (i.e., ambient light level) of the LCD increases, which may reduce the contrast ratio of an outdoor LCD and thereby image quality may be degraded.

The pupils of the human eye constrict as the illuminance increases, and a constricted pupil admits less light. Generally, when seeing a bright image, the human eye can only detect larger gray changes. Thus, on a bright day, a display function of the outdoor LCD may be reduced.

SUMMARY OF THE INVENTION

In an exemplary embodiment of the present invention, a driving method of a liquid crystal display includes sensing illuminance of ambient light, determining a first contrast ratio based on the sensed illuminance, determining a second contrast ratio and a relative ratio of the second contrast ratio and the first contrast ratio, determining a gradient of a compensation gamma curve using the relative ratio, determining an average gray of input data signals, and determining the compensation gamma curve.

The first contrast ratio may be substantially equal to $14514*IL^{-0.8493}$, where IL is the sensed illuminance. The relative ratio (K) may be defined as K=CRd/CRb where CRd is the second contrast ratio and CRb is the first contrast ratio.

The gradient (Gc) of the compensation gamma curve may be defined as Gc=K*Gd, where Gd is a gradient of a first relative gamma curve.

The second contrast ratio and the gradient of the first relative gamma curve may be predetermined.

The first relative gamma curve may be measured in a space substantially lacking light and may have a gamma value of about 1. The relative ratio may be larger than 1.

The input data signals may include luminance information with respect to gray levels, and determining the compensation gamma curve may use a luminance value with respect to the average gray level and the gradient of the compensation gamma curve.

The compensation gamma curve may intersect a second relative gamma curve before a gamma compensation with respect to the liquid crystal display occurs, and a luminance value with respect to the average gray level may be obtained by using the second relative gamma curve.

The second relative gamma curve may be measured in a bright room.

In an exemplary embodiment of the present invention, a driving apparatus of a liquid crystal display includes a photo sensor sensing illuminance of ambient light, and a signal controller connected to the photo sensor and determining a compensation gamma curve based on the sense illuminance, wherein the signal controller determines a first contrast ratio based on the sensed illuminance, determines a second contrast ratio and a relative ratio of the contrast ratio, and determines the compensation gamma curve using the relative ratio and an average gray level of input data signals.

The first contrast ratio is substantially equal to the value of $14514*IL^{-0.8493}$, where IL is the sensed illuminance. The relative ratio (K) may be defined as K=CRd/CRb, where CRd is the second contrast ratio and CRb is the first contrast ratio.

The gradient (Gc) of the compensation gamma curve may be defined as Gc=K*Gd, where Gd is a gradient of a first relative gamma curve.

The second contrast ratio and the gradient of the first relative gamma curve may be predetermined.

The first relative gamma curve may be measured in a space substantially lacking light and may have a gamma value of about 1. The relative ratio may be larger than 1.

The compensation gamma curve may intersect a second relative gamma curve before a gamma compensation with respect to the liquid crystal display occurs and the luminance value with respect to the average gray level may be obtained by using the relative gamma curve.

The second relative gamma curve may be measured in a bright room.

The liquid crystal display may include a plurality of pixels a gray voltage generator, which is connected to the signal controller, to generate a plurality of gray voltages, and a data driver to select a gray voltage corresponding to the input data signals from the gray voltages to transmit the selected gray voltage to the pixels.

BRIEF DESCRIPTION OF THE DRAWINGS

The present invention wilt become readily apparent to those of ordinary skill in the art when descriptions of exemplary embodiments thereof are read with reference to the accompanying drawings.

DESCRIPTION OF EXEMPLARY EMBODIMENTS

Figure 1:
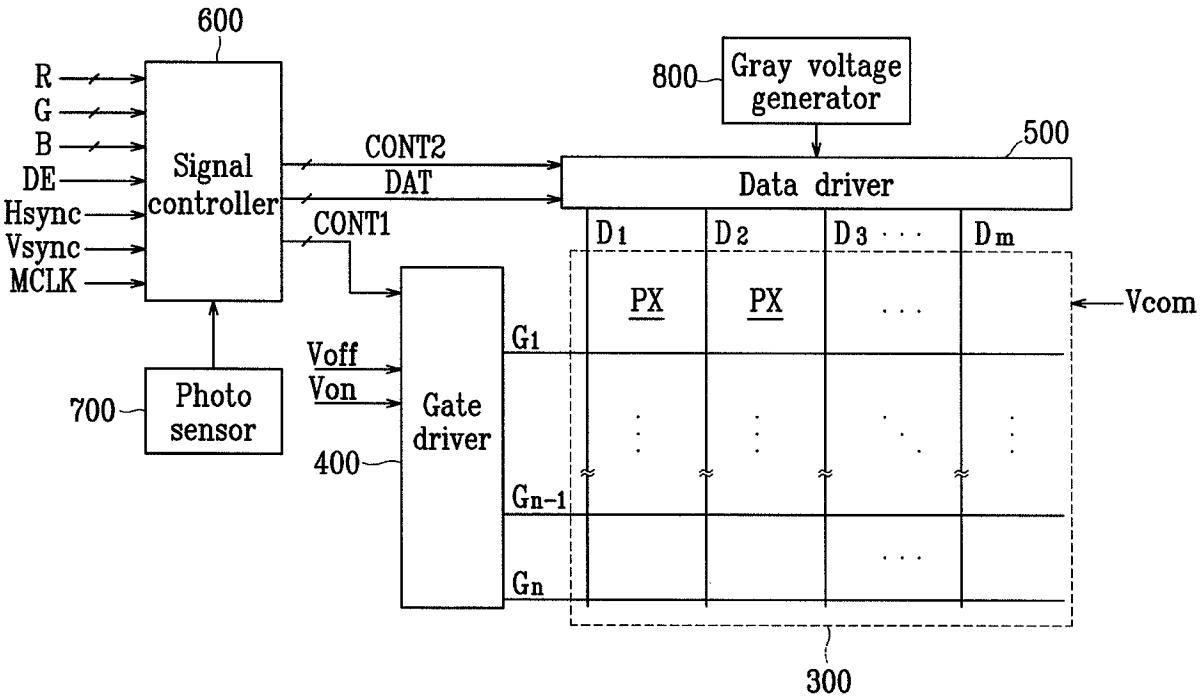
FIG. 1 is a block diagram illustrating an LCD according to an exemplary embodiment of the present invention.

Hereinafter, exemplary embodiments of the present invention will be described in detail with reference to the accompanying drawings. In the drawings, the thickness of layers, films, panels and regions may be exaggerated for clarity. Like reference numerals may refer to the same or similar elements throughout the description of the figures. It will be understood that when an element such as a layer, film, region, substrate, or panel is referred to as being "on" another element, it can be directly on the other element or intervening elements may also be present.

First, an LCD according to an exemplary embodiment of the present invention will be described in detail below with reference to FIGS. 1 and 2

FIG. 1 is a block diagram illustrating an LCD according to an exemplary embodiment of the present invention. FIG. 2 is an equivalent circuit diagram of a pixel of the LCD shown in FIG. 1 according to an exemplary embodiment of the present invention.

Referring to FIG. 1, an LCD includes a liquid crystal (LC) panel assembly 300, a gate driver 400, a data driver 500, a gray voltage generator 800 coupled with the data driver 500, a photo sensor 700, and a signal controller 600. The gate driver 400 and the data driver 500 are coupled with the LC panel assembly 300, and the signal controller 600 controls the above-mentioned components.

The LC panel assembly 300 includes a plurality of signal lines G1-Gn and D1-Dm and a plurality of pixels PX connected to the signal lines G1-Gn and D1-Dm and arranged substantially in a matrix. As shown in FIG. 2, the LC panel assembly 300 includes a lower panel 100 and an upper panel 200 positioned in a plane substantially parallel to the plane of the lower panel 100, and an LC layer 3 interposed therebetween.

The signal lines include a plurality of gate lines G1-Gn for transmitting gate signals (also referred to herein as "scanning signals") and a plurality of data lines D1-Dm for transmitting data voltages. The gate lines G1-Gn extend in a first direction, for example, a row direction and substantially parallel to each other, and the data lines D1-Dm extend in a second direction, for example, a column direction and substantially parallel to each other. The first direction and the second direction are substantially perpendicular to each other.

In exemplary embodiment of the present invention, each pixel PX, for example a pixel PX connected to the i-th gate line Gi (i=1, 2, . . . n) and the j-th data line Dj (j=1, 2, . . . m), includes a switching element Q connected to the signal lines Gi and Dj, an LC capacitor Clc connected to the switching element X, and an optional storage capacitor Cst connected to the switching element Q. The optional storage capacitor Cst may be omitted.

Figure 2:
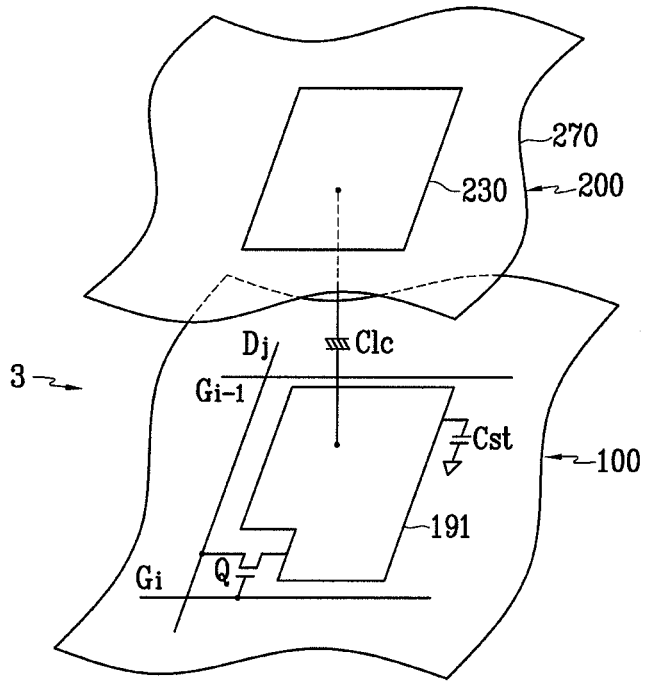
FIG. 2 is an equivalent circuit diagram of a pixel of the LCD shown in FIG. 1 according to an exemplary embodiment of the present invention.

As shown in FIG. 2, the switching element Q is a three-terminal element, and is disposed on the lower panel 100. A control terminal of the switching element Q is connected to the gate line Gi, an input terminal thereof is connected to the data line Dj, and an output terminal thereof is connected to the LC capacitor Clc and the optional storage capacitor Cst.

The LC capacitor Clc uses a pixel electrode 191 disposed on the lower panel 100 and a common electrode 270 disposed on the upper panel 200 as its two terminals. The LC layer 3 interposed between the two electrodes 191 and 270 functions as a dielectric material of the LC capacitor Clc. The pixel electrode 191 is connected to the switching element Q. The common electrode 270 is supplied with a common voltage Vcom and is formed on the entire surface of the upper panel 200. Although not shown as such in FIG. 2, the common electrode 270 may be provided on the lower panel 100. At least one of the electrodes 191 and 270 may be formed in a linear or bar shape.

The storage capacitor Cst may serve as an auxiliary capacitor for the LC capacitor Clc. In the storage capacitor Cst, the pixel electrode 191 and a separate signal line provided on the lower panel 100 may be overlapped with an insulator therebetween. A predetermined voltage, such as the common voltage Vcom, is applied to the separate signal line.

In the storage capacitor Cst, the pixel electrode 191 and an adjacent gate line (also called a previous gate line) may be overlapped with an insulator therebetween.

For color display, each pixel PX may uniquely display one of the primary colors (i.e., spatial division) or each pixel PX may sequentially represent the primary colors in turn (i.e., temporal division) so that a desired color is recognized through a spatial and/or temporal sum of the primary colors. The primary colors may be, for example, red, green, and blue. FIG. 2 shows an example of spatial division, in which each pixel PX includes a color filter 230 for displaying one of the primary colors in a region of the upper panel 200 corresponding to the pixel electrode 191. Although not shown as such in FIG. 2, the color filter 230 may be provided above or below the pixel electrode 191 of the lower panel 100.

One or more polarizers (not shown) for polarizing light are attached to the LC panel assembly 300.

Referring back to FIG. 1, the gray voltage generator 800 generates gray voltages related to the transmittance of the pixels PX. For example, the gray voltage generator 800 may generate a first number of gray voltages or a second number of gray voltages (also referred to herein as "reference gray voltages"). Some of the (reference) gray voltages have a positive polarity relative to the common voltage Vcom, while the other (reference) gray voltages have a negative polarity relative to the common voltage Vcom.

The gate driver 400 is connected to the gate lines G1-Gn of the LC panel assembly 300 and applies the gate signals, which comprise a gate-on voltage Von and a gate-off voltage Voff, to the gate lines G1-Gn.

The data driver 500 is connected to the data lines D1-Dm of the LC panel assembly 300. The data driver 500 selects a gray voltage for each data line D1-Dm from the gray voltage generator 800 and applies the selected gray voltages to the data lines D1-Dm. However, when the gray voltage generator 800 generates only a predetermined number of the reference gray voltages instead of voltages corresponding to all gray scales, the data driver 500 may divide the reference gray voltages to generate gray voltages corresponding to all the gray scales and select the data voltages from the generated gray voltages.

The photo sensor 700 converts illuminance (i.e., ambient light level) information to an electrical signal to transmit it to the signal controller 600.

The signal controller 600 controls the gate driver 490, the data driver and/or other driving devices, based on the signal from the photo sensor 700.

Each of driving devices 400, 500, 600 and 800 may be directly mounted on the LC panel assembly 300 in the form of at least one integrated circuit (IC) chip or mounted on a flexible printed circuit (FPC) firm such as a tape carrier package (TCP), which may be attached to the panel assembly 300. One or more of the driving devices 400, 500, 600 and 800 may be integrated into the LC panel assembly 300 along with the signal lines G1-Gn and D1-Dm and the switching elements Q.

The driving devices 400, 500, 600 and 800 may be integrated into a single IC chip. In this case, at least one of the driving devices 400, 500, 600 and 800 or at least one circuit element forming the driving devices 400, 500, 600, and 800 may be disposed outside of the single IC chip.

Operations of an LCD according to an exemplary embodiment of the present invention will now be described.

The signal controller 600 is supplied with input image signals R, G and B and input control signals for controlling the display of the input image signals R, G, and B from an external graphics controller (not shown). The input image signals R, G, and B contain luminance information for each pixel PX. The luminance has a predetermined number of gray-scale levels, such as for example, 1024 ($=2^{10}$), 256 ($=2^{8}$), or 64 ($2^{6}$). Examples of input control signals may include a vertical synchronization signal Vsync, a horizontal synchronization signal Hsync, a main clock signal MCLK, a data enable signal DE, and the like.

On the basis of the input control signals and the input image signals R, G and B, the signal controller 600 generates a gate control signal CONT1 and a data control signal CONT2. The signal controller 600 processes the image signals P, G, and B in such a way to be suitable for the operating conditions of the LC panes assembly 300 and the data driver 500 based on the input image signals R, Q and B and the input control signals. The signal controller 600 outputs the gate control signal CONT1 to the gate driver 400 and outputs the processed image signals DAT and the data control signal CONT2 to the data driver 500.

The gate control signals CONT1 may include a scanning start signal (STV) for instructing to start scanning, and at least one clock signal for controlling the output period of the gate-on voltage Von. The gate control signals CONT1 may it further include an output enable signal (OE) for defining the duration of the gate-on voltage Von.

The data control signal CONT2 may include a horizontal synchronization start signal (STH) for informing of start of data transmission for a row of pixels PX, a load signal (LOAD) for instructing to apply the data voltages to the data lines D1-Dm, and a data clock signal (HCLK). The data control signal CON12 may further include an inversion signal (RVS) for reversing the polarity of the data voltages (relative to the common voltage Vcom).

Responsive to the data control signal CONT2 from the signal controller 600, the data driver 500 receives a packet of the digital image signals DAT for the row of pixels PX from the signal controller 600, converts the digital image signals DAT into analog data voltages selected from the gray voltages, and applies the analog data voltages to the data lines D1-Dm.

The gate driver 400 applies the gate-on voltage Von to the gate lines G1-Gn in response to the gate control signal CONT1 from the signal controller 600 thereby turning on the switching transistors Q connected to the gate lines G1-Gn. The data voltages applied to the data lines D1-Dm are thus applied to the corresponding pixels PX through the activated switching transistors Q.

A difference between a data voltage and the common voltage Vcom applied to a pixel PX may be represented as a voltage across the LC capacitor Clc of the pixel PX, i.e. a pixel voltage. The LC molecules of the LC layer 3 have different orientations depending on the magnitude of the pixel voltage, and the molecular orientations determine the polarization of light that passes through the LC layer 3. The polarizer(s) converts tight polarization to light transmittance such that the pixel PX has a luminance represented by a gray of the data voltage.

By repeating the above procedure by a unit of 1 horizontal period (which is also referred to as "1H" and is equal to one period of the horizontal synchronization signal Hsync and the data enable signal DE), the gate-on voltage Von is sequentially applied to all gate lines G1-Gn and the data voltages are applied to all the pixels PX to display an image for a frame.

When the next frame starts after one frame finishes, the inversion signal (RVS) applied to the data driver 500 may be controlled such that the polarity of the data voltages is reversed with respect to that applied in a previous frame (which is referred to as "frame inversion"). The inversion signal (RVS) may be controlled such that the polarity of the data voltages applied to a data line are periodically reversed during one frame (for example, row inversion and dot inversion), or the polarity of the data voltages in one packet are reversed (for example, column inversion and dot inversion).

Hereinafter, a method and an apparatus for driving the LCD according to an exemplary embodiment of the present invention will be described with reference to FIGS. 3 through 7.

Figure 3:
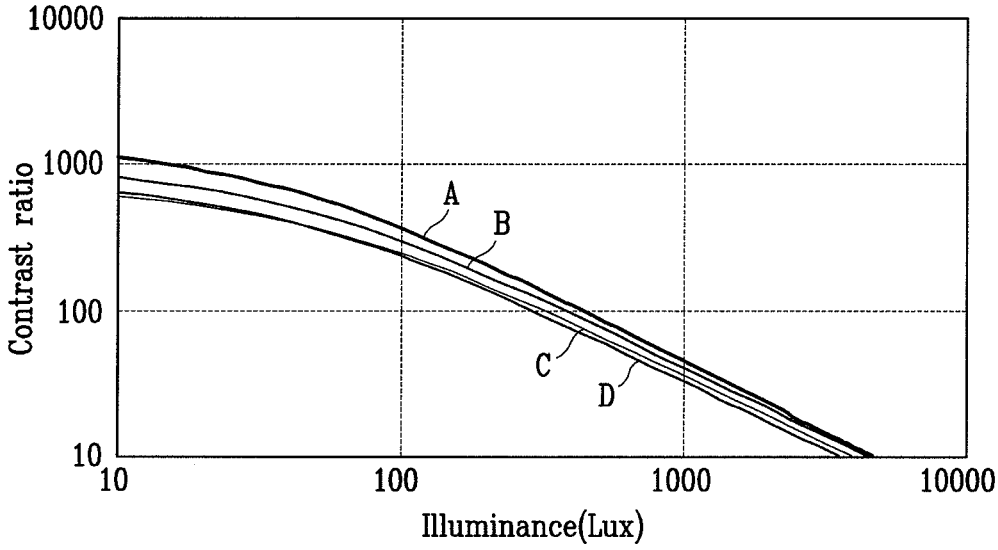
FIG. 3 shows a relationship between the illuminance and a contrast ratio of an LCD according to an exemplary embodiment of the present invention.
Figure 4:
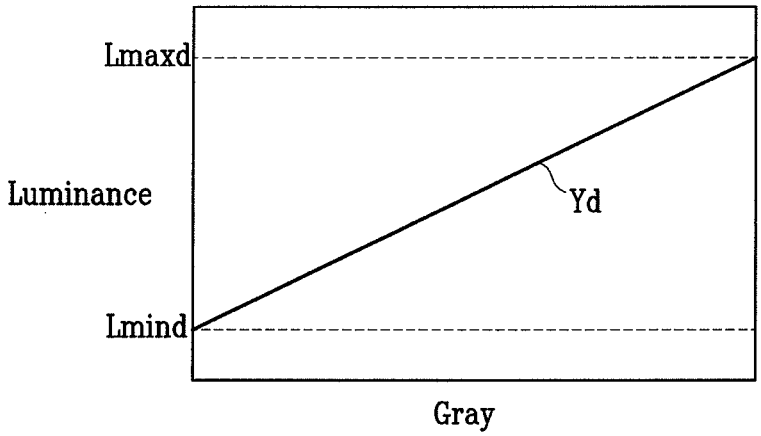
FIG. 4 and FIG. 5 are graphs illustrating examples of relative gamma curves showing a relationship between gray-scale levels and the luminance of an LCD according to exemplary embodiments of the present invention.
Figure 5:
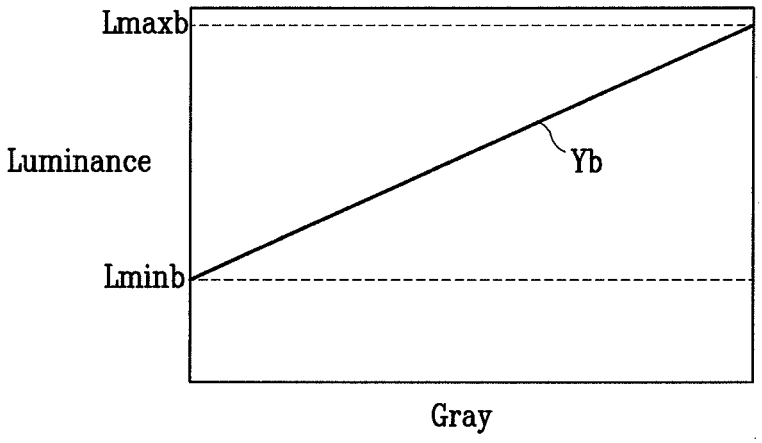
Figure 6:
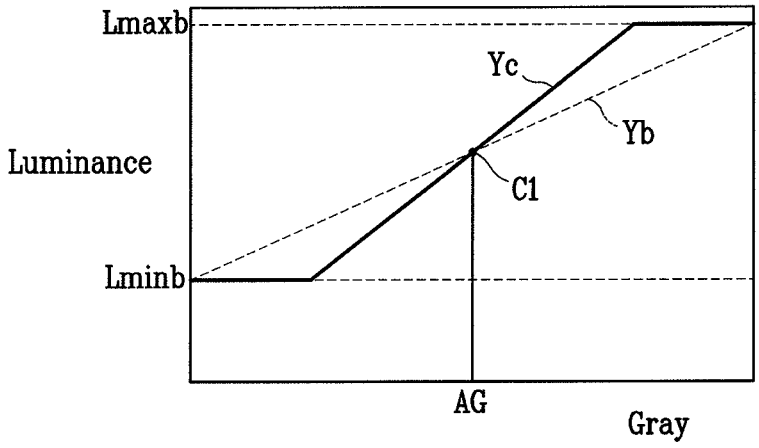
FIG. 6 is a graph showing a comparison result of the relative gamma curve in FIG. 5 and a compensation gamma curve according to an exemplary embodiment of the present invention.
Figure 7:
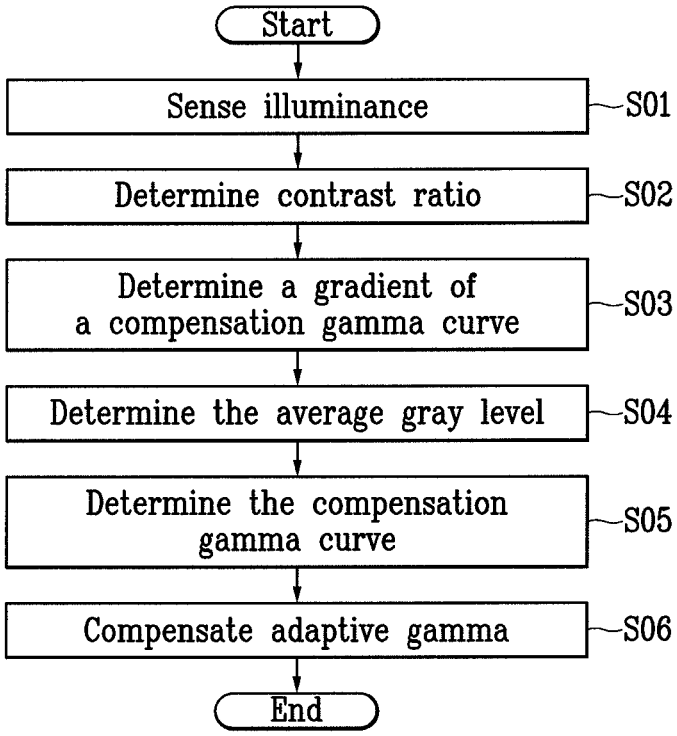
FIG. 7 is a flowchart illustrating a driving method of an LCD according to an exemplary embodiment of the present invention.

FIG. 3 shows a relationship between the illuminance and a contrast ratio of an LCD according to an exemplary embodiment of the present invention. FIG. 4 and FIG. 5 are graphs illustrating examples of relative gamma curves showing a relationship between gray-scale levels and the luminance of an LCD according to an exemplary embodiment of the present invention. FIG. 6 is a graph showing a comparison result of the relative gamma curve in FIG. 5 and a compensation gamma curve. FIG. 7 is a flowchart illustrating a driving method of an LCD according to an exemplary embodiment of the present invention.

In FIG. 3, a horizontal axis represents illuminance, a unit of the horizontal axis is Lux, and a vertical axis represents contrast ratio. The graph shown in FIG. 3 was obtained by measuring relationships between illuminance and contrast ratio with respect to a plurality of LCDs A, B, C, and D.

Referring to FIG. 3, as the illuminance IL increases, the contrast ratio Y exponential-functionally decreases, as expressed by Equation 1.

$$Y=N*IL^{-E}, \quad \text{[Equation 1]}$$

where N and E are constants. For example, a value satisfying Equation 1 was obtained in the LCD A.

$$CRb=14514*IL^{-0.8493}, \quad \text{[Equation 2]}$$

where CRb is a contrast ratio measured in a bright room, and IL represents illuminance (i.e., ambient light level).

As used herein, the term "light room" refers to a space in which some light exists, and the term "dark room" refers to a space in which light is substantially blocked.

Meanwhile, when the bit number of a data signal of the LCD is 8, the number of gray-scale levels is 256 ($=2^8$), and luminance that is represented by the LCD in each of the gray-scale levels can be represented as a graph. The graph is referred to as a gamma curve. For example, in Equation 1, "illuminance (IL)" may be replaced by a gray level, and an equation for a gamma curve is obtained. In this case, since an exponential portion (E) is usually replaced by a gamma (γ), the curve is called a gamma curve. The gamma curve exponential-functionally increases or decreases according to a value of a gray level. In an LCD of a normally black mode, as a value of the gray level increases, the luminance of the gamma curve exponential-functionally increases.

For example, the value of the gamma (γ) is about 2.2 in some LCDs, and the value of the gamma (γ) is increased to about 2.4 in CODs for televisions to increase their luminance.

In an exemplary embodiment of the present invention, the value of gamma (γ) is defined to be about "1". In this case, the gamma curve has a linear shape. Linear analysis of the gamma curve allows for simplifying an algorithm as well as for providing convenience of analysis. Since the value of the gamma (γ) is defined for convenience of analysis, the value of the gamma (γ) may be changed. A gamma curve for which the value of the gamma (γ) is "1" may be referred to as "a relative gamma curve"

Since the relative gamma curve and a compensation gamma curve are linear functions, as expressed by Equation 3, when a gradient (Cc) and a point on the compensation gamma curve are obtained, an equation for the compensation gamma curve is obtained. Hereinafter, a method for calculating the gradient and a method for calculating a point on the compensation gamma curve will be described.

$$Yc=Gc*X+Y1, \quad \text{[Equation 3]}$$

where Yc is a compensation gamma curve, Gc is a gradient of the compensation gamma curve, and Y1 represents a point intersecting the Y-axis.

FIGS. 4 and 5 show examples of relative gamma curves Yd and Yb, respectively. A gradient of the relative gamma curve Yd is denoted "Gd", and a gradient of the relative gamma curve Yb is denoted "Gb". In comparing the two relative gamma curves Yd and Yb, the maximum luminance Lmaxb measured in a bright room is slightly larger than the maximum luminance Lmaxd measured in a dark room, but the minimum luminance Lminb measured in the bright room is much larger than the minimum luminance Lmimd measured in the dark room. This result is due to the reflection of ambient light.

The gradient of the relative gamma curve Yb obtained in the bright room is smaller than that of the relative gamma curve Yd obtained in the dark room. The contrast ratio (CR) is a ratio of the maximum luminance (Lmax) and the minimum luminance (Lmin), for example, as expressed by Equation 4.

$$CR=Lmax/Lmin \quad \text{[Equation 4]}$$

When the respective contrast ratios in the dark room and the bright room are obtained, a relative ratio (K) may be defined as Equation 5

$$K=CRd/CRb, \quad \text{[Equation 5]}$$

where, CRd is the contrast ratio in the dark room, and CRb is the contrast ratio in the bright room, and the relative ratio (K) is larger than "1".

Since the constants N and E in Equation 1 may be calculated by varying the ambient illuminance of the LCD A, for example, the contrast ratio CRb in the bright room may be determined using Equation 2.

A gamma curve may be obtained by measuring luminance with respect to each gray level in the dark room, and the gradient Gd of the relative gamma curve Yd in the dark room and the contrast ratio CRd in the dark room may be defined as constants.

In addition, the relative gamma curve Yb in the bright room may be experimentally calculated by measuring the luminance with respect to each gray level, for example, similar to the contrast ratio CRb in the bright room as expressed by Equation 2.

By multiplying the gradient Gd of the measured relative gamma curve Yd in the dark room by the relative ratio K, a gradient Gc of the compensation gamma curve is obtained, which can be written as Equation 6.

$$Gc=K*Gd \quad \text{[Equation 6]}$$

Thus, when the gradient Gc of the compensation gamma curve is larger than the gradient Gd of the relative gamma curve Yd measured in the dark room, the gradient Gc of the compensation gamma curve is much larger than the gradient Gb of the relative gamma curve Yb measured in the bright room.

After the gradient Gc of the compensation gamma curve is obtained, when a point on the compensation gamma curve is obtained, Equation 3 of the compensation curve Yc is obtained, as shown in FIG. 6. A point on the compensation gamma curve may be obtained using the average gray AG.

According to an exemplary embodiment of the present invention, the average gray AG of the input data signals R, G, and B is positioned on the relative gamma curve Yb measured in the bright room before the compensation, and the average gray AC and a luminance value corresponding to the average gray AC become a point (e.g., defined by an X-axis value and a Y-axis value) on the compensation gamma curve.

As shown in FIG. 6, the compensation gamma curve has the gradient Gc and is a line passing through a point C1.

Referring to FIG. 6, the average gray AG is positioned at the middle of the two relative gamma curves Yb and Yc, and the two curves Yb and Yc finally intersect at the point C1. The gradient Gc of the compensation gamma curve is larger than the gradient Gb of the relative gamma curve Yb measured in the bright room.

In an exemplary embodiment of the present invention, the compensation gamma curve Yc is substantially the same as the result obtained by rotating the relative gamma curve Yb measured in the bright room with respect to the point C1, and a variation width of the luminance increases, and the visibility may increase.

As shown in FIG. 6, since the gradient becomes large, a high gray level and a low gray level represent the maximum luminance Lmaxb and the minimum luminance Lminb in an LCD. The gray levels of less than the average gray AG represent lower luminance and the gray levels larger the average gray AG represent higher luminance. As a result, since the contrast ratio increases, the visibility improves.

Next, a driving method of an LCD according to an exemplary embodiment of the present invention will be described with reference to FIG. 7.

The photo sensor 700 senses illuminance IL of ambient light (step S01) and converts the sensed illuminance to an electrical signal to transmit to the signal controller 600. For example, a voltage or current is outputted in proportion to or inversely proportionate to the sensed illuminance IL.

The signal controller 600 determines a contrast ratio CRb for example in accordance with Equation 2 (step S02), based on the signal from the photo sensor 700.

In addition, the signal controller 600 determines a gradient Gc of a compensation gamma curve for example, based on Equation 4 and Equation 5 (step S03), and the average gray AG (step S04), to obtain the compensation gamma curve (step S05).

The signal controller 600 outputs a control signal based on the compensation gamma curve Yc to the gray voltage generator 800 and the gray voltage generator 800 transmits a gray voltage based on the compensation gamma curve Yc to the data driver 500 to embody the gamma compensation suitable to the outdoor LCD (step S06). Based on the concept of the gamma compensation according to illuminance variation from the outside, the driving method of the signal controller 600 may be called "adaptive gamma compensation".

Small-sized display devices such as for a mobile phone may use low-reflective optical sheets that have lower reflectivity outdoors than indoors, and thereby the visibility of the small-sized display devices increases. In a driving method of a liquid crystal display according to an exemplary embodiment of the present invention, the visibility may be improved without the use of reflective sheets, and the manufacturing cost may be reduced. It will be appreciated that a driving method of a liquid crystal display according to an exemplary embodiment of the present invention may be used in conjunction with the use of reflective sheets, and the visibility may be further improved.

Although exemplary embodiments of the present invention have been described detail with reference to the accompanying drawings for the purpose of illustration, it is to be understood that the inventive processes and apparatus should not be construed as limited thereby, it will be apparent to those of ordinary skill in the art that various modifications to the foregoing exemplary embodiments can be made without departing from the scope of the invention as defined by the appended claims, with equivalents of the claims to be included therein.

What is claimed is:

1. A driving method of a liquid crystal display, comprising:
sensing illuminance of ambient light;
determining a first contrast ratio based on the sensed illuminance;
determining a second contrast ratio when the ambient light is substantially blocked;
determining a relative ratio (K) of the second contrast ratio to the first contrast ratio;
determining a gradient of a compensation gamma curve using the relative ratio (K);
determining an average gray level of input data signals;
determining the compensation gamma curve based on the determined average level of input data signals; and
driving the liquid crystal display based on the determined compensation gamma curve,
wherein the gradient (Gc) of the compensation gamma curve defined as Gc=K*Gd, where Gd is a gradient of a first relative gamma curve.

2. The driving method of claim 1, wherein the first contrast ratio is substantially equal to the value of $N*IL^{-E}$, where N and E are constants greater than zero, IL is the sensed illuminance, and a unit of IL is Lux.

3. The driving method of claim 1, wherein the second contrast ratio and the gradient of the first relative gamma curve are predetermined.

4. The driving method of claim 3, wherein the first relative gamma curve is measured in a space substantially lacking light and has a gamma value of about 1.

5. The driving method of claim 4, wherein the relative ratio (K) is larger than 1.

6. The driving method of claim 5, wherein the input data signals comprises luminance information with respect to gray levels, and determining the compensation gamma curve uses a luminance value with respect to the average gray level and the gradient of the compensation gamma curve.

7. A driving method of a liquid crystal display, comprising:
sensing illuminance of ambient light;
determining a first contrast ratio based on the sensed illuminance;
determining a second contrast ratio when the ambient light is substantially blocked;
determining a relative ratio (K) of the second contrast ratio to the first contrast ratio;
determining a gradient of a compensation gamma curve using relative ratio;
determining an average gray level of input data signals which comprises luminance information with respect to gray levels;
determining the compensation gamma curve using a luminance value with respect to the average gray level of input data signals and the gradient of the compensation gamma curve; and
driving the liquid crystal display based on the determined compensation gamma curve,
wherein the compensation gamma curve intersects a second relative gamma curve before a gamma compensation with respect to the liquid crystal display occurs, and the luminance value with respect to the average gray level is obtained by using the second relative gamma curve.

8. The driving method of claim 7, wherein the second relative gamma curve is measured in a bright room.

9. A driving apparatus of a liquid crystal display, comprising:
a photo sensor configured to sense illuminance of ambient light; and
a signal controller connected to the photo sensor and configured to determine a compensation gamma curve based on the sensed illuminance, to determine a first contrast ratio based on the sensed illuminance, to determine a second contrast ratio when the ambient light is substantially blocked, to determine a relative ratio (K) of the second contrast ratio to the first contrast ratio, to determine an average gray level of input data signals, and to determine the compensation gamma curve using the relative ratio (K) and the average gray level of input data signals,
wherein a gradient (Gc) of the compensation gamma curve is defined as Gc=K*Gd, where Gd is a gradient of a first relative gamma curve.

10. The driving apparatus of claim 9, wherein the first contrast ratio is substantially equal to the value of $N*IL^{-E}$, where N and E are constants greater than zero, IL is the sensed illuminance, and a unit of IL is Lux.

11. The driving apparatus of claim 9, wherein the second contrast ratio and the gradient of the first relative gamma curve are predetermined.

12. The driving apparatus of claim 11, Wherein the first relative gamma curve is measured in a space substantially lacking light and has a gamma value of about 1.

13. The driving apparatus of claim 12, wherein the relative ratio (K) is larger than 1.

14. A driving apparatus of a liquid crystal display, comprising:
a photo sensor configured to sense illuminance of ambient light; and a signal controller connected to the photo sensor and configured to determine a compensation gamma curve based on the sensed illuminance, to determines a first contrast ratio based on the sensed illuminance, to determine a second contrast ratio when the ambient light is substantially blocked, to determine a relative ratio (K) of the second contrast ratio to the first contrast ratio, to determine an average gray level of input data signals which comprises luminance information with respect to gray levels, and to determine the compensation gamma curve using a luminance value with respect to the average gray level of input data signals and the gradient of the compensation gamma curve, wherein the compensation gamma curve intersects a second relative gamma curve before a gamma compensation with respect to the liquid crystal display occurs, and the luminance value with respect to the average gray level is obtained by using the second relative gamma curve.

15. The driving apparatus of claim 14, wherein the second relative gamma curve is measured in a bright room.

16. The driving apparatus of claim 15, wherein the liquid crystal display comprises:

a plurality of pixels;

a gray voltage generator, which is connected to the signal controller, to generate a plurality of gray voltages; and a data driver to select a gray voltage corresponding to the input data signals from the gray voltages to transmit the selected gray voltage to the pixels.

17. The driving apparatus of claim 10, wherein N is 14514, and E is 0.8493.

18. The driving method of claim 2, wherein N is 14514, and E is 0.8493.

* * * * *